US005464199A

United States Patent [19]

Stauber

[11] Patent Number: 5,464,199

[45] Date of Patent: Nov. 7, 1995

[54] GATHERING STAPLER FOR PRINTED PRODUCTS COMPRISING FOLDED PRINTED SHEETS

[75] Inventor: Hans-Ulrich Stauber, Grut, Switzerland

[73] Assignee: Ferag AG, Switzerland

[21] Appl. No.: 172,649

[22] Filed: Dec. 23, 1993

[30] Foreign Application Priority Data

Jan. 11, 1993 [CH] Switzerland ..... 00061/93

[51] Int. Cl.[6] ..... B42B 4/02; B27F 7/17

[52] U.S. Cl. ..... 270/53; 227/81

[58] Field of Search ..... 270/37, 38, 53, 270/54, 58; 227/4, 5, 6, 49, 50, 81, 105; 412/18, 33

[56] References Cited

U.S. PATENT DOCUMENTS

| | | | |
|---|---|---|---|
| 715,890 | 12/1902 | Smyth et al. . | |
| 2,717,383 | 9/1955 | Stobb . | |
| 3,762,622 | 10/1973 | Noren . | |
| 3,951,399 | 4/1976 | Reist . | |
| 4,058,202 | 11/1977 | Reist et al. . | |
| 4,408,754 | 10/1983 | Meier . | |
| 4,408,755 | 10/1983 | Meier . | |
| 4,416,448 | 11/1983 | Meier . | |
| 4,684,116 | 8/1987 | Hänsch . | |
| 4,706,951 | 11/1987 | Leu . | |
| 4,709,910 | 12/1987 | Honegger . | |
| 4,729,554 | 3/1988 | Honegger . | |
| 4,735,406 | 4/1988 | Weber | 270/53 |
| 4,750,661 | 6/1988 | Pane . | |
| 4,792,077 | 12/1988 | Faltin | 270/37 X |
| 4,898,336 | 2/1990 | Reist . | |
| 4,981,291 | 2/1990 | Honegger et al. . | |
| 4,995,563 | 2/1991 | Kälin . | |
| 5,042,792 | 8/1991 | Honegger et al. . | |
| 5,052,666 | 10/1991 | Hänsch . | |
| 5,052,667 | 10/1991 | Hänsch . | |
| 5,137,409 | 8/1992 | Honegger | 270/53 X |
| 5,172,897 | 12/1992 | Hänsch et al. | 270/53 |
| 5,174,557 | 12/1992 | Meier | 270/37 X |
| 5,342,032 | 8/1994 | Meier | 270/53 X |
| 5,356,125 | 10/1994 | Hansch et al. | 227/81 X |

FOREIGN PATENT DOCUMENTS

| | | |
|---|---|---|
| 0399317A1 | 5/1990 | European Pat. Off. . |
| 1055499 | 4/1966 | Germany . |
| 2116734C2 | 4/1971 | Germany . |

*Primary Examiner*—John E. Ryznic

*Attorney, Agent, or Firm*—Willian Brinks Hofer Gilson & Lione

[57] ABSTRACT

A novel gathering stapler for printed products comprising folded printed sheets is provided. The gatherer stapler comprises a plurality of gathering sections defined by saddle-shaped rests which extend parallel to one another and circulate transversely to their longitudinal extent. The printed sheets are gathered and stapled on the gathering sections. A rotary stapling apparatus is also provided. The stapling apparatus has essentially stellately arranged stapling heads which are driven with the gathering sections in a stapling region in such a way that they meet up. Each of the stapling heads includes a plurality of staple guides arranged on a rotating carrier for seating on the printed products, and a plurality of push rods. The push rods engage telescopically in the staple guides.

14 Claims, 7 Drawing Sheets

VI
35
29
10
11
111
32
13
17
14
30
12
VII
VII
24
31
23
33
292
29
17
171
91
25
VI
9

GATHERING STAPLER FOR PRINTED PRODUCTS COMPRISING FOLDED PRINTED SHEETS

BACKGROUND OF THE INVENTION

The present invention relates to a gathering stapler for printed products, namely folded printed sheets.

Gathering staplers are known in the art. The nature and operating principle of rotary stapling devices has long been known to persons skilled in the art. Rotating stapling heads commonly include a push rod for driving in the staples. The displaceable push rod is guided in the radial direction. Prior art examples of such gathering staplers include the arrangement disclosed in U.S. Pat. No. 4,408,755 and the corresponding Swiss Patent No. 645,074. These references teach a gathering stapler capable of gathering printed sheets, which are initially still joined together in the form of folded webs, without the usual opening devices. The gathered printed sheets gathered are then stapled in the stapling region of the circulating rests by a rotary stapling apparatus.

In prior art gathering stapler devices, the push rod is constantly changing its angular position during the driving in of the staples. Usually, the push rod and rest, which supports the product to be stapled, are aligned only in a single rotational position. Despite this arrangement, rotary stapling devices are used not only in the above mentioned context, but also in a wide variety of fields.

Therefore, it is an object of the present invention to provide a rotary gathering stapler in which the stapling heads and the rests are aligned with each other over an entire rotational region. Alignment over an entire rotational region would increase the operational reliability, even at an elevated rotational speed. Furthermore, it would be possible to work with different qualities of wire and/or lengths of wire and correspondingly different staple dimensions with minimal setting work.

SUMMARY OF THE INVENTION

A novel gathering stapler for printed products comprising folded printed sheets is provided. The gatherer stapler comprises a plurality of gathering sections defined by saddle-shaped rests which extend parallel to one another and circulate transversely to their longitudinal extent. The printed sheets are gathered and stapled on the gathering sections. A rotary stapling apparatus is also provided. The stapling apparatus has essentially stellately arranged stapling heads which are driven with the gathering sections in a stapling region in such a way that they meet up. Each of the stapling heads includes a plurality of staple guides arranged on a rotating carrier for seating on the printed products, and a plurality of push rods. The push rods engage telescopically in the staple guides. The trajectory of the staple guides and the path of circulation of the rests are such that they intersect. The staple guides are swiveably mounted to swivel out of a leading position into a trailing position, and secured displaceably inward against a restoring force.

One advantage of the present invention is that the stapling heads and the rests are aligned over an entire rotational region.

These and other advantages, as well as the invention itself, will be better understood in light of the enclosed drawings, a brief description of which follows.

DETAILED DESCRIPTION OF THE PRESENTLY PREFERRED EMBODIMENTS OF THE INVENTION

Figure 1:
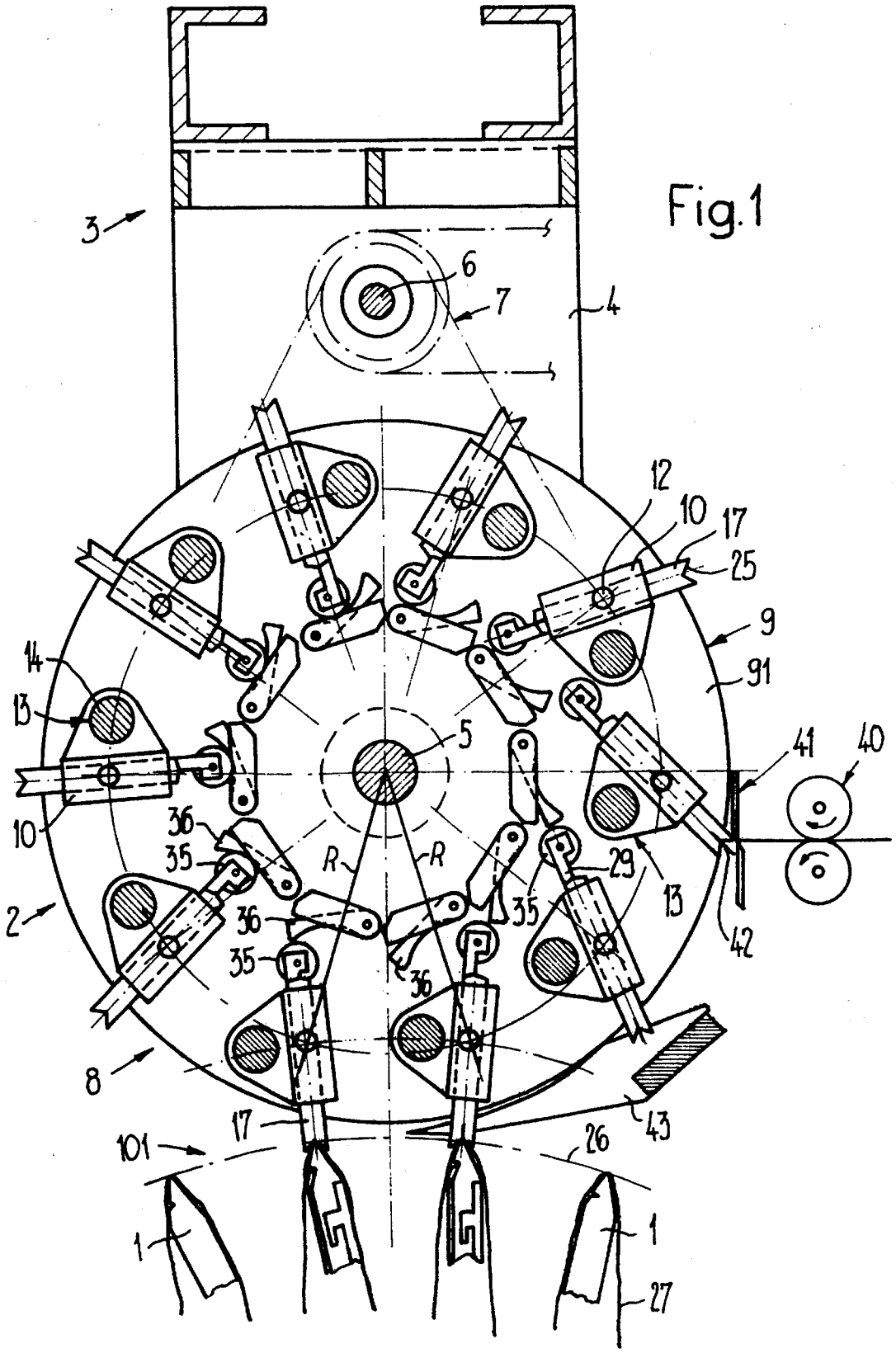
FIG. 1 is a side view of a section of a preferred embodiment of the rotary stapling apparatus of the present invention.
Figure 2:
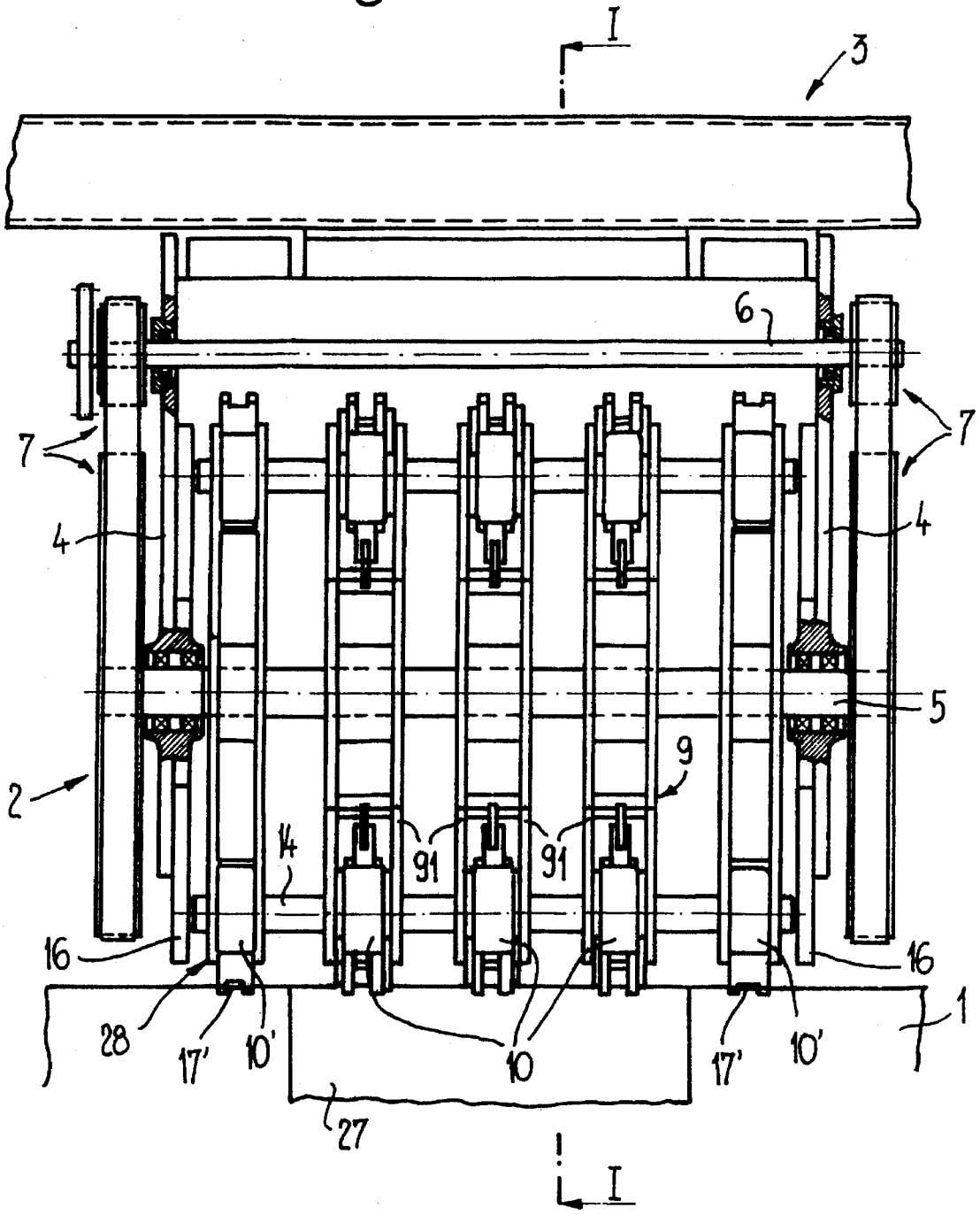
FIG. 2 is a perspective view of the rotary stapling apparatus of FIG. 1.

Referring initially to FIG. 1, a preferred embodiment of the apparatus of the present invention is shown. The apparatus includes rests 1 which form a gathering system. Printed products, preferably sheets, are supported by the rests 1 and axially conveyed during rotation of the gathering system. In the preferred embodiment, the rests form a drum-shaped gathering system 101, such as that disclosed in U.S. Pat. No. 3,951,399 issued to Walter Reist, which is incorporated herein by reference. However, the arrangement of the rests 1 and the manner of gathering the printed sheets on the rests 1 is insignificant and therefore may vary.

Directly above the gathering drum 101 there is a rotary stapling apparatus 2. The rotary stapling apparatus 2 is suspended by two side walls 4 on the machine frame 3. The side walls 4 are shared with the gathering drum 101. A driveshaft 5 and countershaft 6 are connected to each other each by a toothed-belt drive 7 and mounted on side walls 4.

A stapling head assembly 8 is located on the driveshaft 5 of the stapling apparatus 2. In the preferred embodiment, the stapling head assembly 8 includes three double-walled carrier disks 9, which are connected in a rotationally fixed manner to the driveshaft. Stapling heads 10 are stellately distributed in the interior of the double-walled carrier discs 9. As FIG. 1, in combination with FIG. 6 or 7, reveals the housing 11 of the stapling heads 10 is swivel-mounted in the walls 91 of the carrier disks 9 by pins 12.

The swivelling position of the stapling heads 10 is determined by a joint 13 which acts on the stapling head housing 11. The joints of the stapling heads 10 are mounted in other carrier disks 9 but on the same "star arms", i.e. radii R, being connected to one another by a common joint spindle 14. As depicted in FIG. 1 in combination with FIG. 7, the ends of the joint spindles 14 are guided in endless, enclosed control grooves 15 (not shown in FIG. 1) by control disks 16 which for their part are each fixedly anchored in place, bearing against the inner side of the side walls 4, but preferably rotationally adjustable.

The apparatus is aligned such that the stapling heads 10, more specifically the stapling guides 17, meet the rests 1 in the leading position relative to the radius of the swivel pins 12, and leave said rests in the trailing position. Therefore, in the stapling region, the angular position of the stapling heads 10 does not correspond to that of the relevant radii. Instead, the angular position of the stapling heads 10 changes essentially like that of the rests 1, so that the rests 1 and the stapling heads 10 are aligned with one another, not only in a single rotational position, but in a rotational region i.e. in the stapling region.

Figure 5:
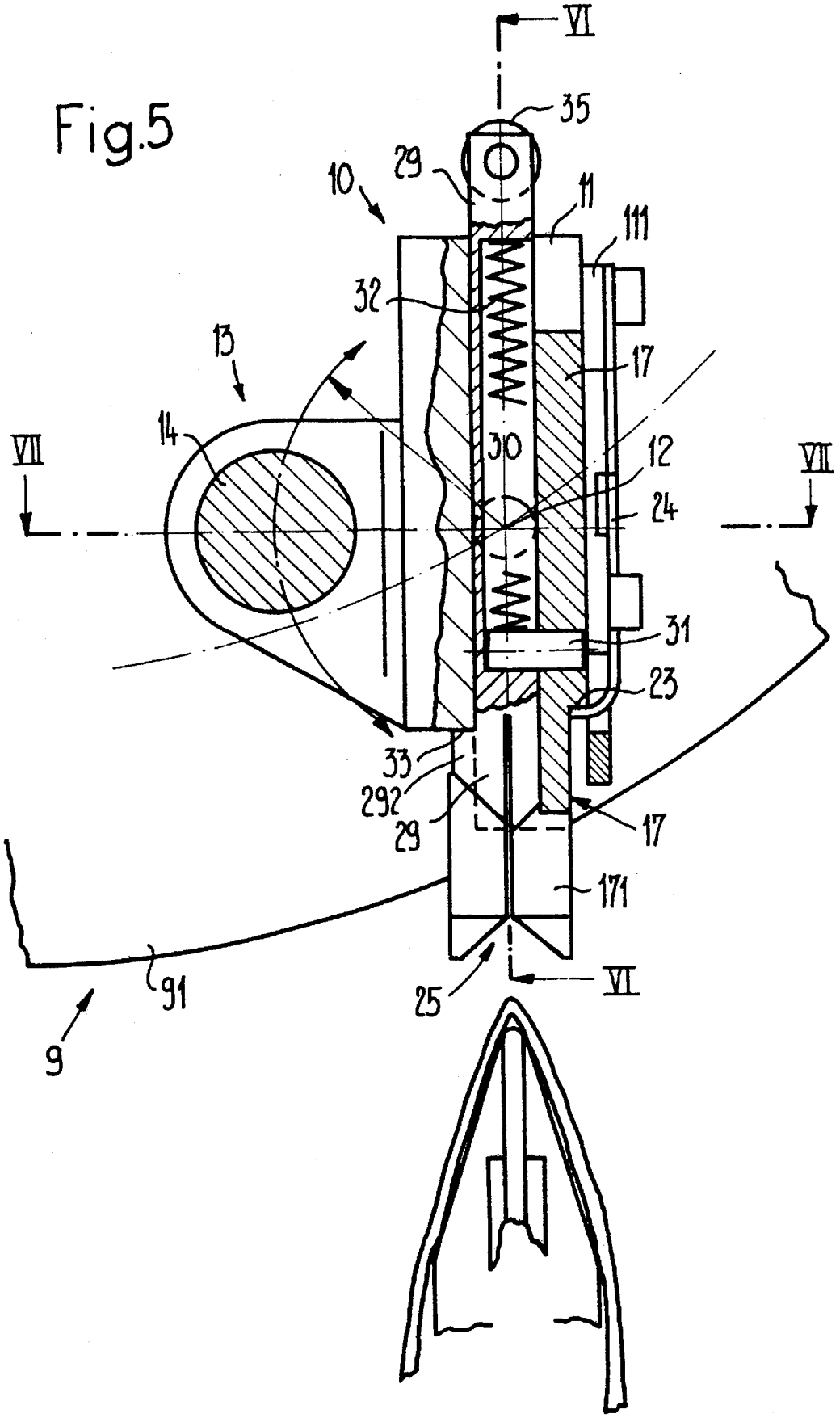
FIG. 5 is an enlarged cross-sectional view of a single stapling head of the apparatus of FIG. 3.
Figure 6:
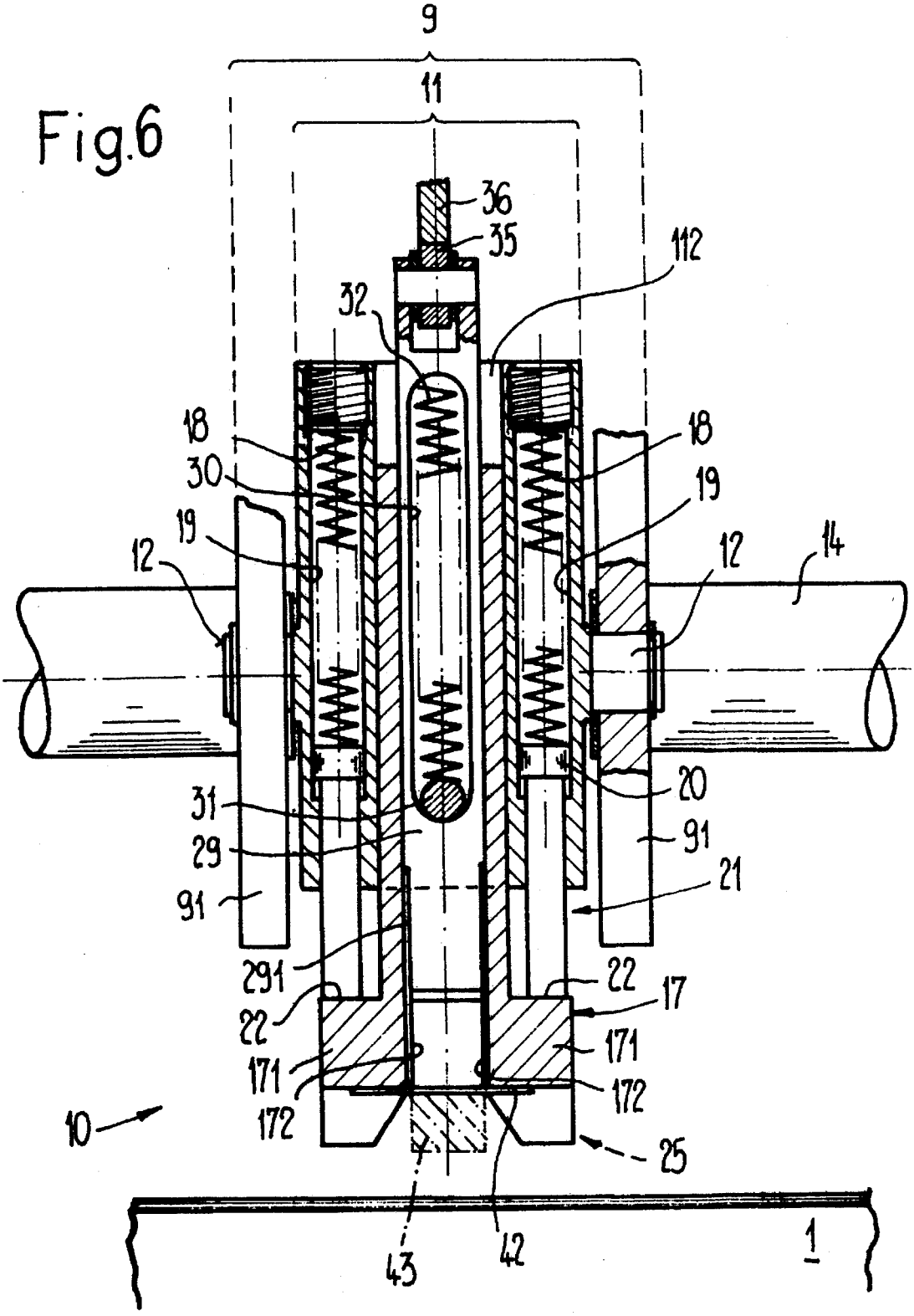
FIG. 6 is a cross-sectional view of the apparatus of FIG. 5 taken along lines VI—VI.
Figure 7:
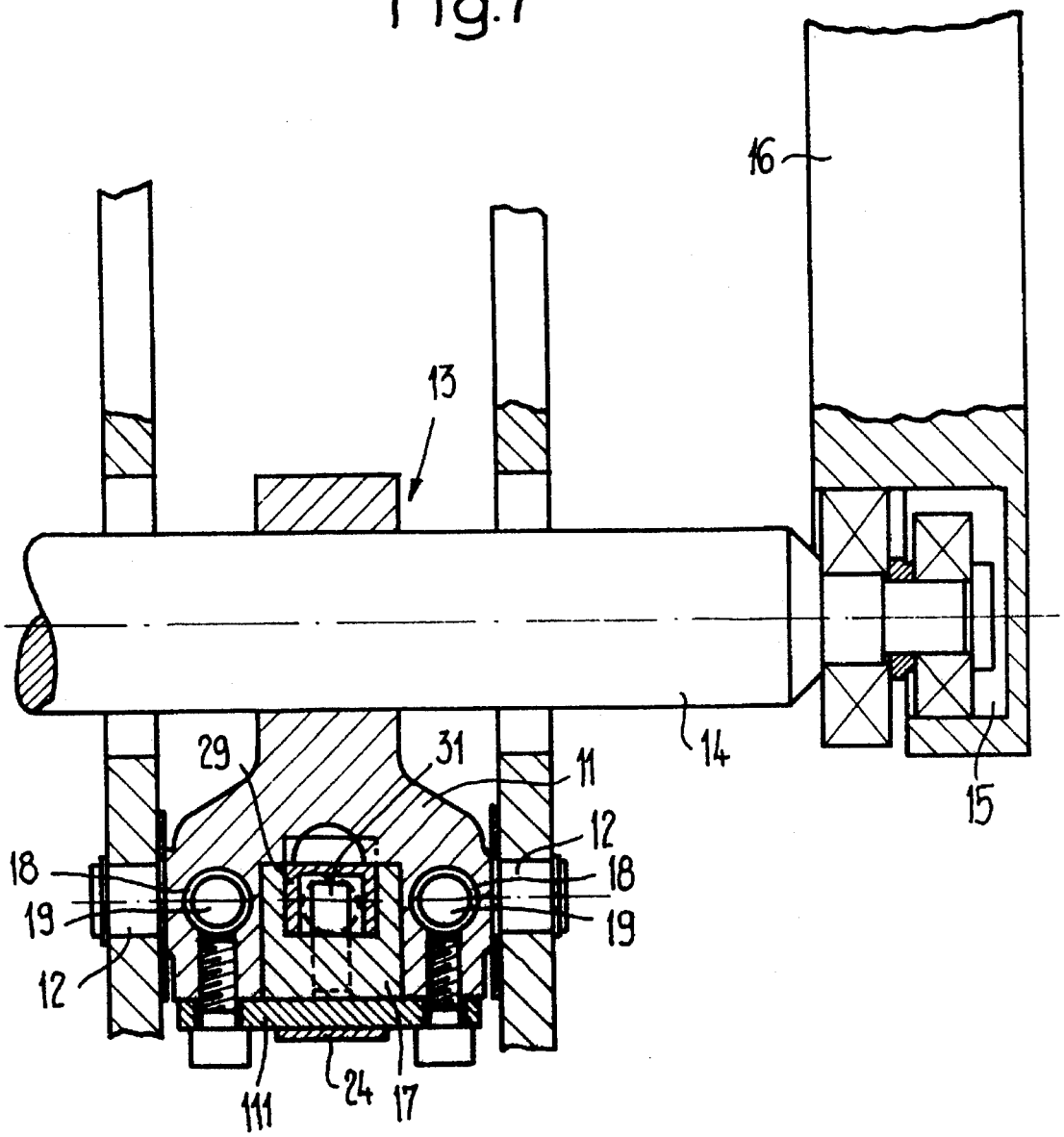
FIG. 7 is a cross-sectional view of the apparatus of FIG. 5 taken along lines VII—VII and folded into the plane of FIG. 6.

As illustrated in FIGS. 5–7, the staple guide 17 is inwardly displaceable in the stapling head housing 11. Restoring springs 18 oppose inward placement of the staple guide 17. Restoring springs 18, are arranged in blind bores 19 of the stapling head housing 11 and are supported on the shoulders 22 of the staple guide 17 by a bolt-shaped counterholder 21, provided with a head 20. As depicted in FIG. 6, the counterholders 21 are guided into the housing 11. Once inside the housing 11, the counter-holders 21 are captured by their head 20 in the blind bores 19 of the housing 11. In the operationally ready position of the staple guide 17, the head 20 of the counterholders 21 is not on its seating. This allows the restorative force of the spring 18 to take full effect. The staple guide 17 is held against the restorative force by a stop 23 (FIG. 5), which is fixed to the housing. The stop 23 is designed as a disconnectable locking bolt and formed by the angled-off end of a leaf spring 24 anchored on the housing cover 111. The cover 111 closes the open side of the cross-sectionally U-shaped housing 11 and the stop 23 engages a shoulder of the staple guide 17 in the stapling head housing 11. See FIG. 7.

In this stop position, the trajectory of the staple guides 17, more specifically of the V-shaped centering attachments 25 attached to the ends of the staple guides 17, intersects the path of circulation 26 of the rests 1 (cf., for example, FIG. 1). Consequently, when the staple guides 17 meet the rests 1, the staple guides 17 are lifted off the stops 23 and pushed back into the stapling head housing 11. At the same time, the stapling heads 10 are accurately centered on the rests 1. Any deviations from the relative desired positions is compensated for by the compliance of the rests 1. Conversely, when leaving the stapling region, the staple guides 17, under the restorative force of restoring springs 18 follow the rests 1 and gradually detach themselves from the rests 1. This is significant because the gathered printed sheets located on the rests 1, or the printed products 27 formed by the gathered printed sheets, must not be damaged by the action of the centering attachments 25.

Double-walled centering disks 28 are located to the right and left of the outer carrier disks 9. The double-walled centering disks 28 carry centering heads 10' between their walls. The design of the centering heads 10' corresponds to that of the stapling heads 10. However, the centering heads 10' only function is to center the stapling head carrier 8 relative to the gathering system by the pseudo staple guides 17'. The pseudo staple guides 17' act with V-shaped centering attachments directly on the rests 1. This arrangement enables the stapling head carrier 8 to be secured so that it can be swung away from the drum 101 in order to exchange stapling heads 10 and convert the system to different production specifications, i.e., a different number of staplings, different staple dimensions, etc.

As depicted in FIGS. 5, 6 and 7, the staple guides 17 are displaceable in the guide channel 112 of the housing 11 which is closed off by the cover 111. The staple guides 17 are U-shaped in cross section, so that together with the bottom of the guide channel 112 they form an inner guide for the push rods 29 engaging in the staple guides 17. Push rods 29 have a longitudinal slot 30, in which a pin 31 of the staple guide 17 engages. A spring 32 arranged in the slot 30 is supported on the pin 31 or on the push rod 29. The spring 32 pushes the push rod 29 and the staple guide 17 away from each other. The pin 31 sets an absolute limit to this movement. Staple guide 17 and the push rod 29 engaging it can easily form an assembly unit which may be withdrawn from the housing, in the manner of a drag connection. In this case, the pin 31 would strike against the end of the slot 30. In the reverse direction, the push rod 29 or the staple guide 17 can be displaced relative to each other, even in the installed state.

As shown in FIG. 5, in the staple guide's 17 installed state, the resting position of the push rod 29 is determined by a stop 292. Stop 292 interacts with a counterstop 33 formed on the stapling head housing 11. Thus, if the staple guide 17 is pushed back into the stapling region by a rest 1, the drag connection comes into action keeping the relevant push rod 29 stationary and tensioning spring 32 to a correspondingly greater extent.

Each staple guide 17 is forked at its free end. The fork is formed by legs 171 which, with their V-shaped end faces, form the centering attachments Longitudinally directed guide grooves 172, located on the inner side walls so the legs 171, are intended to receive the legs of a U-shaped staple 34. See FIG. 4*a*. Push rod ribs 291 engage in the guide grooves 172 thereby pushing the staples 34 out of the guide grooves 172 when there is relative movement between staple guide 17 and push rod 29.

Figure 3:
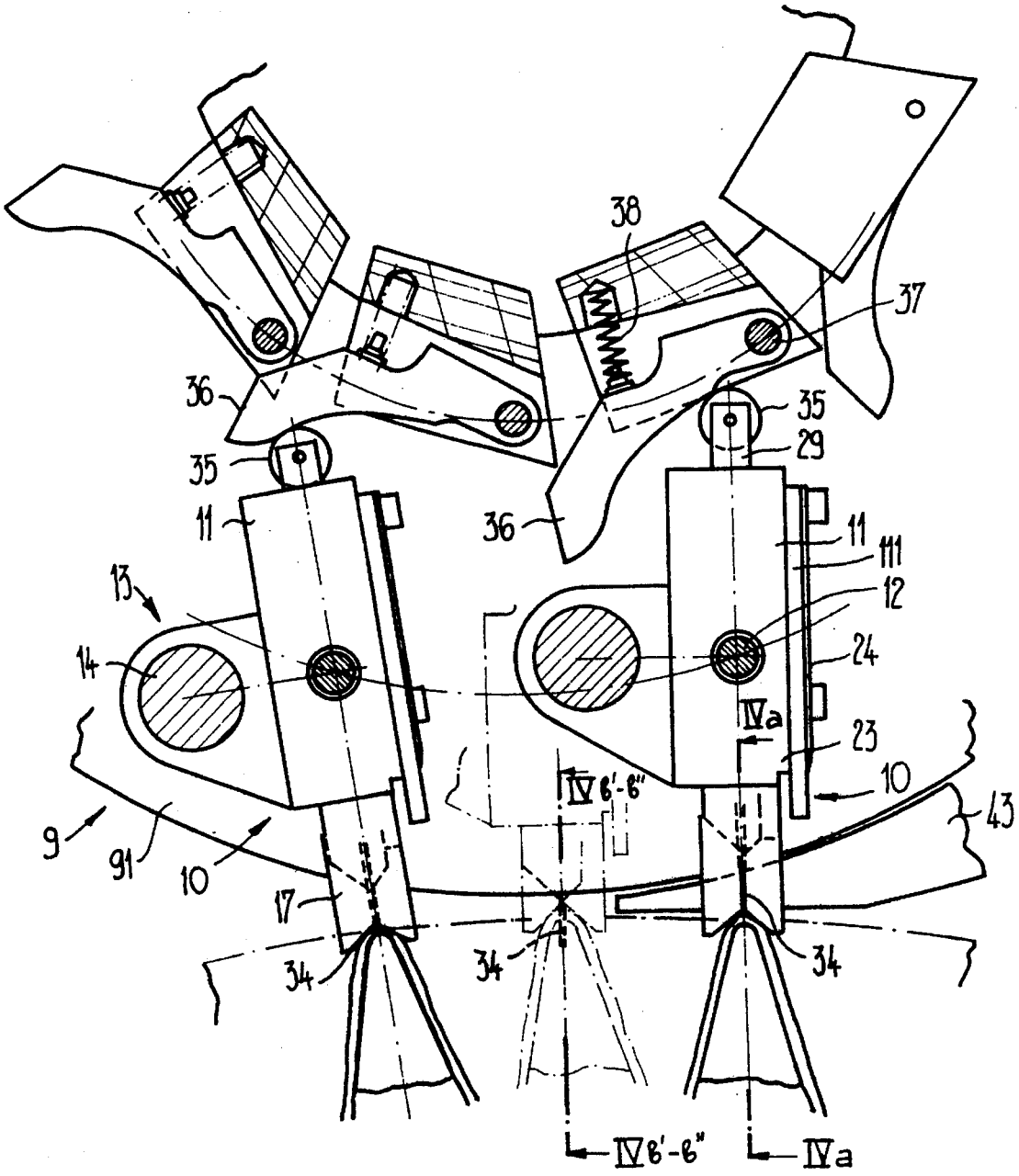
FIG. 3 is an enlarged view of the stapling region of the apparatus of FIG. 1.

Each push rod 29 bears a follow-up roller 35 on its free end. The follow-up roller 35 interacts with a control link 36 from the relevant stapling head 10 (FIGS. 1 and 3). However, as indicated in FIG. 1, an effective connection does not result until the stapling head 10 is moved by the positive control 13-14-15-16 out of its leading position and into the trailing position. As shown in FIG. 3, the profile of the control link 36 initially advances the push rod 29 out of its stop position and into a new position. Although the control link 36 is swivel-mounted at a pin 37 on the stapling head carrier 8, the force of a supporting spring 38 acting on the link 36 is nevertheless sufficient to prevent any giving way of the control link 36.

The intersection of the trajectory of the staple guides 17 and the circulating path 26 of the rests 1 cause the staple guide 17 to be lifted off the stop 23 and pushed back into the stapling head housing 11 by the rest 1 when a rest 1 meets a staple guide 17. Control 35–36 of the push rod 29 is also involved due to the swivelling of the stapling head about the pin 12. Starting from an initial position represented in FIG. 3 at a), and resulting in FIG. 3 at b), the staple 34 is soon driven (b') into the product located on the rest 1. Finally, the staple is closed (b").

Figure 4:
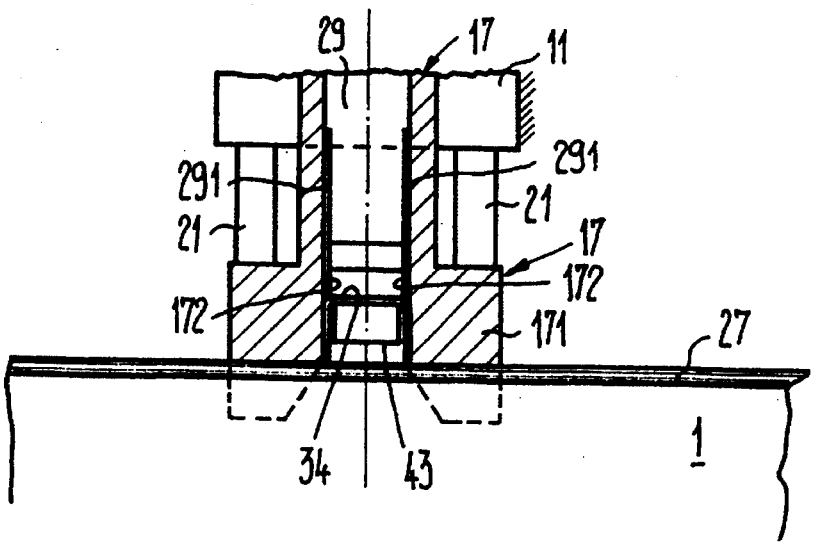
FIG. 4 is a series of enlarged views of the apparatus of FIG. 3 taken along lines IVa, IVb (b"–b') and IVc.
Figure 4:
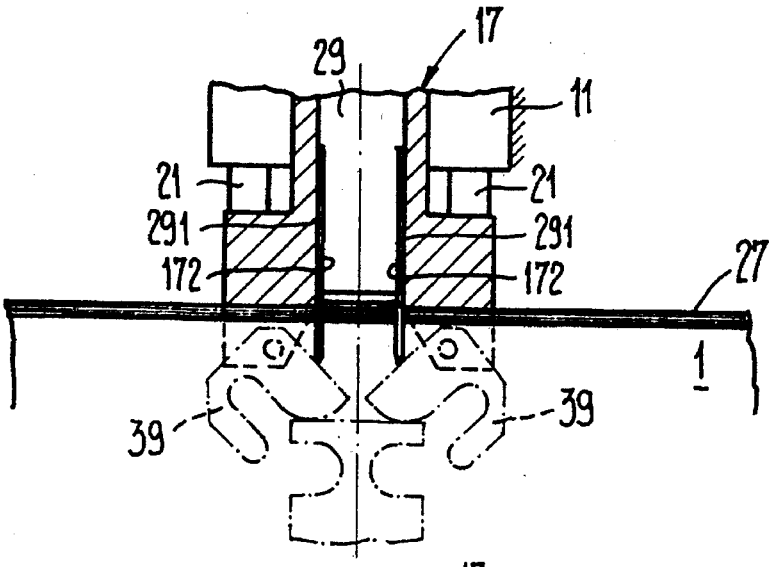
Figure 4:
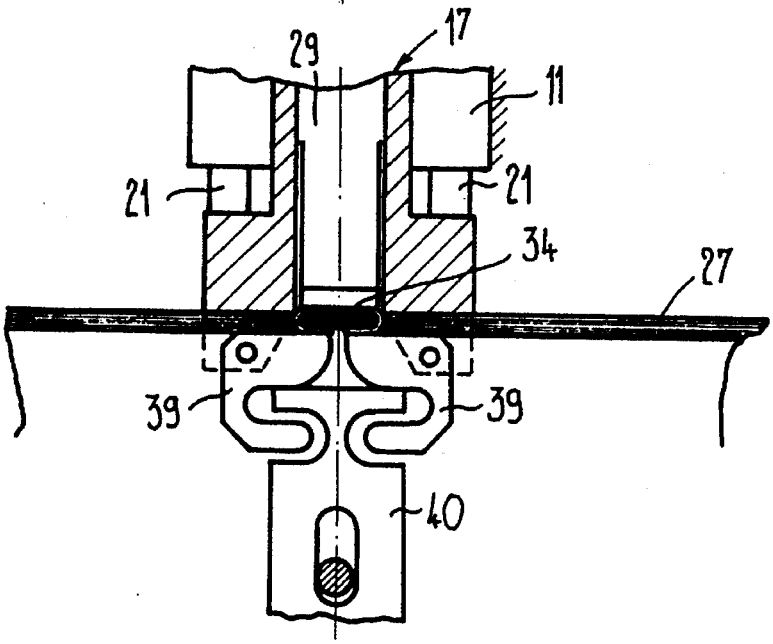

As depicted in FIGS. 4b' and 4b", closing the staple 34 is accomplished by controlled bending-over means 39, which interact in pairs and are actuated by a common push rod 140. Controlled bending-over means 39 are provided in the rests 1 for each stapling head 10. After the product has been penetrated, the staple legs strike the bending-over means 39 and are deflected inward.

During this closing operation, which occurs in a small rotational region, the push rod 29 interacts as a counterholder with the bending-over means 39. After reaching the stop 23, the stapling head 10 is swivelled back into the leading position and, as a result, the control cam 36 makes the push rod 29 travel back to its stop 292. At the same time, the staple guide 17 follows the rest 1 and moves away from the stapling head 10, in the direction of its stop 23. The stapling head 10 is now ready to receive another staple 34.

The manner of feeding the staple 34 to the stapling heads 10 can be determined with reference to FIGS. 1 and 6. In FIG. 1, the wire advancement is indicated at 40 and the wire cutter of a wire cut-off dispenser is indicated at 41. As explained, for example, in European Patent A1 476 718, the stapling heads run past the wire cut-off dispenser, from which their staple guides take over a wire section 42 (FIG. 6). The wire section 42 may be magnetically held in the V-shaped ends of the legs 171, until the relevant stapling head runs into the region of a fixed-in-place wire-bending link or cam 34. The wire-bending link 34 acts on the wire section 42 in its central region, which is pressed in between the legs 171. The ends of the wire section are bent around and drawn into the guide grooves (cf. FIG. 4*a*). Consequently, the staple 34 is formed, or the stapling head 10 is loaded for renewed stapling. The link 43 ends, as shown in FIG. 3, directly before the stapling region.

There are many advantages to the gathering stapler apparatus of the present invention. First, the stapling heads and the rests are aligned with each other over an entire rotational region. This increases the reliability of the apparatus, even at an increased rotational speed.

Second, the special alignment also creates the potential to work with different qualities or lengths of wire or different staple dimensions with minimal setting work.

It should be appreciated that the apparatus of the present invention is capable of being incorporated in the form of a variety of embodiments without departing from its spirit or essential characteristics. The described embodiments are to be considered in all respects only as illustrative and not restrictive, and the scope of the invention is therefore, indicated by the appended claims rather than by the foregoing description. All changes which come within the meaning and range of equivalency of the claims are to be embraced within their scope.

I claim:

1. A gathering stapler for stapling printed products comprising folded printed sheets along a product fold, the stapler comprising:

a plurality of elongated saddle-shaped rests extending parallel to each other and circulating transversely to their longitudinal extent while the printed sheets are gathered and stapled on them;

a rotary stapling apparatus having a plurality of stapling heads and being driven for rotation about an axis of rotation in such a way that each of said stapling heads successively meets up with a rest in a stapling region as the rests circulate and the stapling apparatus rotates;

each of said stapling heads including a staple guide for holding a staple and adapted to seat on a printed product arranged on one of said rests when the latter meets with said stapling head in the stapling region and further including a push rod movably guided within said staple guide;

said staple guides of said plurality of stapling heads being mounted on a carrier rotating about said axis of rotation for an orientation in a substantially radial direction and for a swiveling movement about an axis extending substantially parallel to said axis of rotation through an arc in such a way that the staple guides swivel out of a leading position into a trailing position, in relation to their substantially radial direction, when they meet the rests in the area of the stapling region, said staple guides being further mounted on said carrier for a displacement inwardly against a restoring force; and the trajectory of the ends of said staple guides and the path of circulation of said rests intersect and each staple guide being displaced inwardly by the associated rest when said staple guide meets up with said associated rest in the stapling region.

2. The gathering stapler as claimed in claim 1, wherein the staple guides are provided with a centering attachment engaging around the rests.

3. The gathering stapler as claimed in claim 2, wherein the staple guides are positively actuated for said swivelling movement by a follow-up control, so that they run into the stapling region in the leading position and leave it in the trailing position.

4. The gathering stapler as claimed in claim 3, wherein the staple guides are mounted on the rotating carrier for a swivelling movement about an axis and are connected to the follow-up control by a joint arranged eccentrically in relation to the axis.

5. The gathering stapler as claimed in claim 4, wherein a plurality of carriers are arranged on a common shaft at intervals, the joints of the staple guides which are respectively seated on the same radius having a continuous common pin, the pin being guided at both its ends in a fixed control slot of the control.

6. The gathering stapler as claimed in claim 1, wherein each staple guide is guided displaceably in a stapling head housing and rests on a stop of the housing directed against the restoring force, while the push rod guided in the staple guide is supported inward by a counterstop of the housing.

7. The gathering stapler as claimed in claim 6, wherein the staple guides and the push rods engaging in them are in each case configured as an assembly unit which can be withdrawn from the housing, the unit comprising:

a spring interposed between each staple guide and the associated push rod, the spring pushing the staple guide and push rod away from each other; and a further stop and further counterstop to limit the movement of the push rod relative to the staple guide.

8. The gathering stapler as claimed in claim 6 wherein:

the stops assigned to the staple guides are configured as disconnectable locking bars; and spring-loaded counterholders are provided in the stapling head housing, which in the locking position of the staple guides act on the latter, and in the non-locking position when the staple guides are removed can be displaced to a predetermined limit.

9. The gathering stapler as claimed in claim 6, wherein the push rods are actuated by means of a follow-up control, responding when the staple guides are transferred out of the leading position into the trailing position.

10. The gathering stapler as claimed in claim 9, wherein the push rods bear at their free end a follow-up roller, which in each case interacts with a sprung control link, anchored on the carrier.

11. The gathering stapler as claimed in claim 1, further comprising a staple-wire dispenser and a stationary wire-bending ling arranged one following the other in the rotating direction of the carrier, the wire-bending link having a path which gradually enters into the trajectory of the staple guides between two legs of the staple guides and extends into the region of the intersection of the trajectory of the staple guides and the path of circulation of the rests.

12. The gathering stapler as claimed in claim 10 comprising bending-over means, arranged inside the rests, the bending-over means being actuated by a follow-up control synchronously with the push rod control.

13. The gathering stapler as claimed in claims 1 comprising centering disks disposed adjacent to the rotating carrier, the centering rotors having securing means, arranged and controlled in a way corresponding to the staple guide housings, for centering attachments which are displaced against a restoring force and engage in a meshing manner around the rests.

14. The gathering stapler of claim 1 further characterized by and including:

a) resilient means constantly tending to urge said staple guides generally toward the axis of said rotary stapling apparatus.

* * * * *

UNITED STATES PATENT AND TRADEMARK OFFICE

CERTIFICATE OF CORRECTION

PATENT NO. : 5,464,199
DATED : November 7, 1995
INVENTOR(S) : Hans-Ulrich Stauber It is certified that error appears in the above-indentified patent and that said Letters Patent is hereby corrected as shown below:

On the Title Page , Item [56]

In column 2, line 3, delete "2/1990" and substitute --1/1991--.

Under the heading "FOREIGN PATENT DOCUMENTS", line 2, delete "4/1966" and substitute --4/1956--.

In the Claims

In claim 11, line 55, delete "ling" and substitute --link--.

In claim 13, line 66, delete "claims" and substitute --claim--.

Signed and Sealed this

Twenty-third Day of July, 1996

*Attest:*

*Attesting Officer*

BRUCE LEHMAN

*Commissioner of Patents and Trademarks*